US005544994A

United States Patent [19]

Similä

[11] Patent Number: 5,544,994

[45] Date of Patent: Aug. 13, 1996

[54] FEED DEFLECTION APPARATUS FOR AT LEAST PARTIALLY FOLDED NEWSPAPERS OR MAGAZINES

[75] Inventor: Jussi Similä, Järvenpää, Finland

[73] Assignee: Oy GMA Printing Systems Ab, Jarvenpaa, Finland

[21] Appl. No.: 350,651

[22] Filed: Dec. 7, 1994

[51] Int. Cl.[6] ..... B42B 5/00

[52] U.S. Cl. ..... 412/9; 412/33

[58] Field of Search ..... 412/9, 18, 25, 412/33

[56] References Cited

U.S. PATENT DOCUMENTS 4,681,500 7/1987 Rathert et al. ..... 412/33

4,872,797 10/1989 Schniter ..... 412/33 X 5,174,556 12/1992 Taylor et al. ..... 412/33 X

*Primary Examiner*—Willmon Fridie, Jr.

*Attorney, Agent, or Firm*—Barry R. Lipsitz

[57] ABSTRACT

The invention relates to a feed deflection apparatus for at least partially folded newspapers or magazines. A pair of arrester cylinders (1) and a pair of acceleration cylinders (2) are coplanar but at an angle of 90° relative to each other. A paper subjected to compression by the tail between the pair of arrester cylinders (1) is stopped by decelerating the cylinders (1). At the moment said paper has stopped, the pair of acceleration cylinders (2) takes hold of the paper's edge and accelerates it to a new speed directed at an angle of 90° relative to the previous direction. The apparatus can be used for assembling or disassembling piles of papers. A particularly practical application is feeding papers from a printing machine to an after-treatment trimmer.

10 Claims, 5 Drawing Sheets

FEED DEFLECTION APPARATUS FOR AT LEAST PARTIALLY FOLDED NEWSPAPERS OR MAGAZINES

The after-treatment, so-called trimming of at least partially folded newspapers or magazines emerging from a printing machine often involves the problem that the feed direction of a paper or magazine does not comply with that required by the after-treatment apparatus. This is one of the reasons why the trimming is nowadays generally effected as a separate after-treatment on stapling lines, which are slow and thus require a lot of personnel and floor space.

An object of the invention is to provide a high-speed feed deflection apparatus capable of ensuring the precise direction and position of a paper or magazine in such a manner that the apparatus can be used upstream of various trimmers or alternatively for assembling or disassembling piles of papers or magazines.

This object is achieved on the basis of the characterizing features set forth in the appended claims.

For example, the pages of A4-papers are generally positioned upright, the direction of the back being the traveling direction. However, the high-speed rotary staplers are only functional when the path runs transversely to the back. An apparatus of the invention enables particularly the stapling and cylinder-effected back folding but also other after-treatment (such as the longitudinal trimming of the ends of a paper and/or transverse trimming of the side of a paper) transversely to the paper web emerging from a printing machine.

The invention will now be described in more detail with reference made to the accompanying drawings, in which FIG. 1 shows schematically in a perspective view the operating principle of an apparatus of the invention at the initial stage of arrest.

As depicted in FIGS. 1–4, a paper tail-pressed between a pair of arrester cylinders 1 is stopped or arrested by controllably decelerating the cylinders 1 at such a deceleration that the paper does not slip between the pair of cylinders 1. When the invention is applied as a feed deflection apparatus for at least partially folded newspapers or magazines emerging from a printing machine, the arresting is effected in synchronization with the printing machine (feeding machine), e.g. 15 times a second. Deceleration and arresting of the cylinders 1 can be effected mechanically, hydraulically or electrically.

The pair of acceleration cylinders 2 lies in the same plane as the pair of arrester cylinders 1 but at an angle of 90° relative thereto. At the moment a paper has stopped, the pair of acceleration cylinders 2 takes hold of the paper's edge and accelerates the paper to a new speed at an angle of 90° relative to the former direction. The speed can be equal to the incoming speed or slower or faster but the frequency of accelerations is the same as that of the feeding machine.

Figure 1:
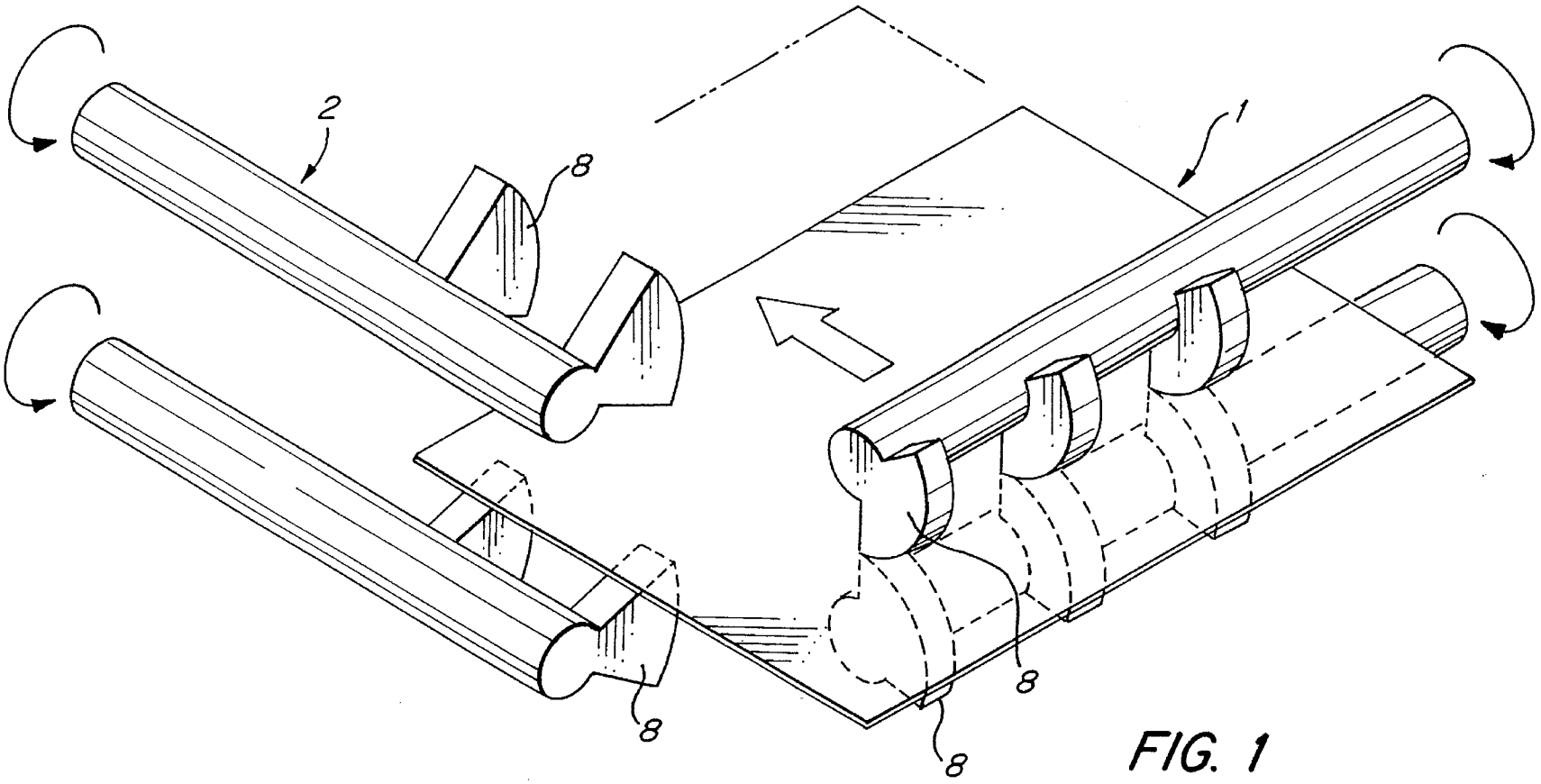
Figure 2:
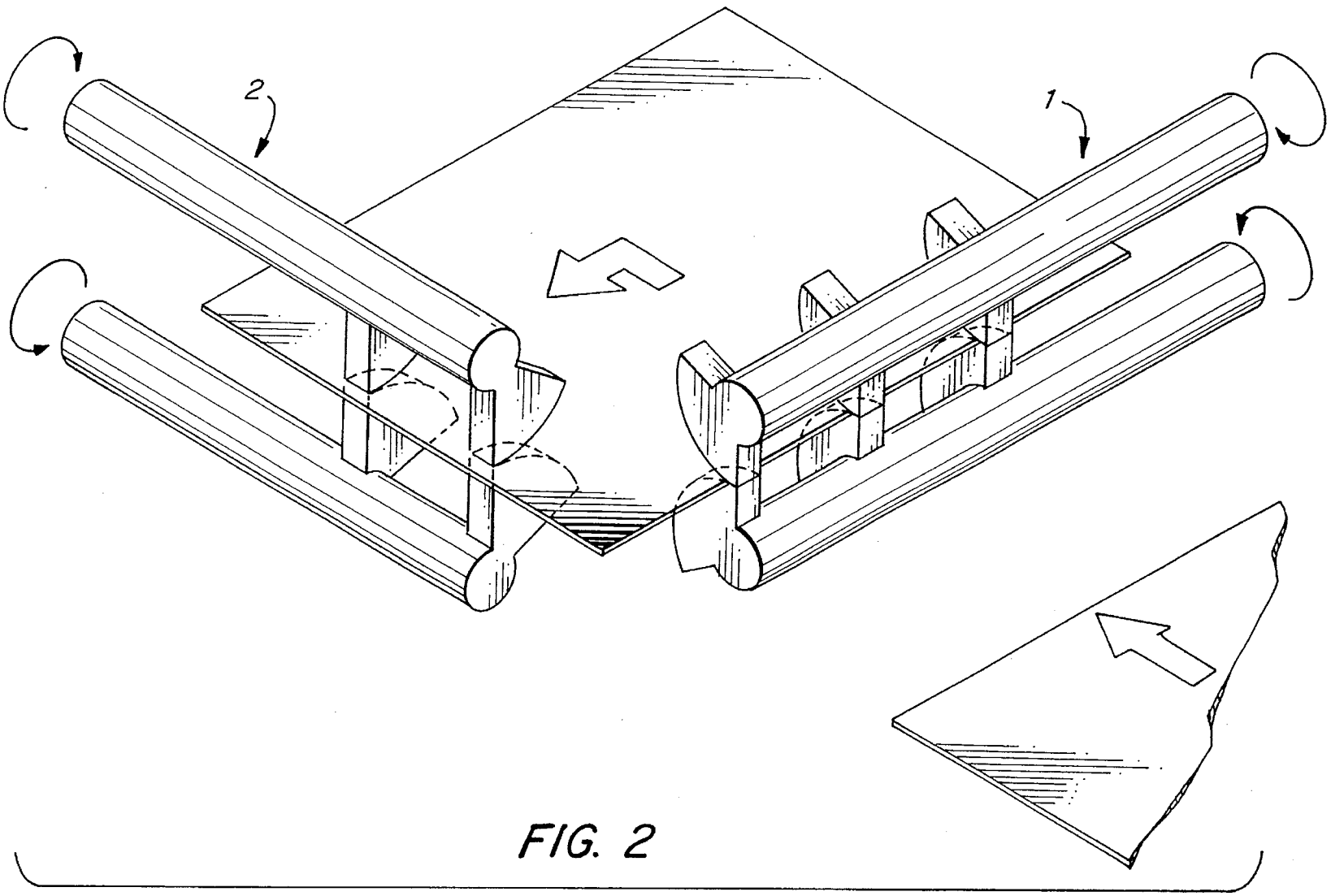
FIG. 2 shows the same as FIG. 1 but in the situation that the paper has been arrested and acceleration in a new direction commences.
Figure 3:
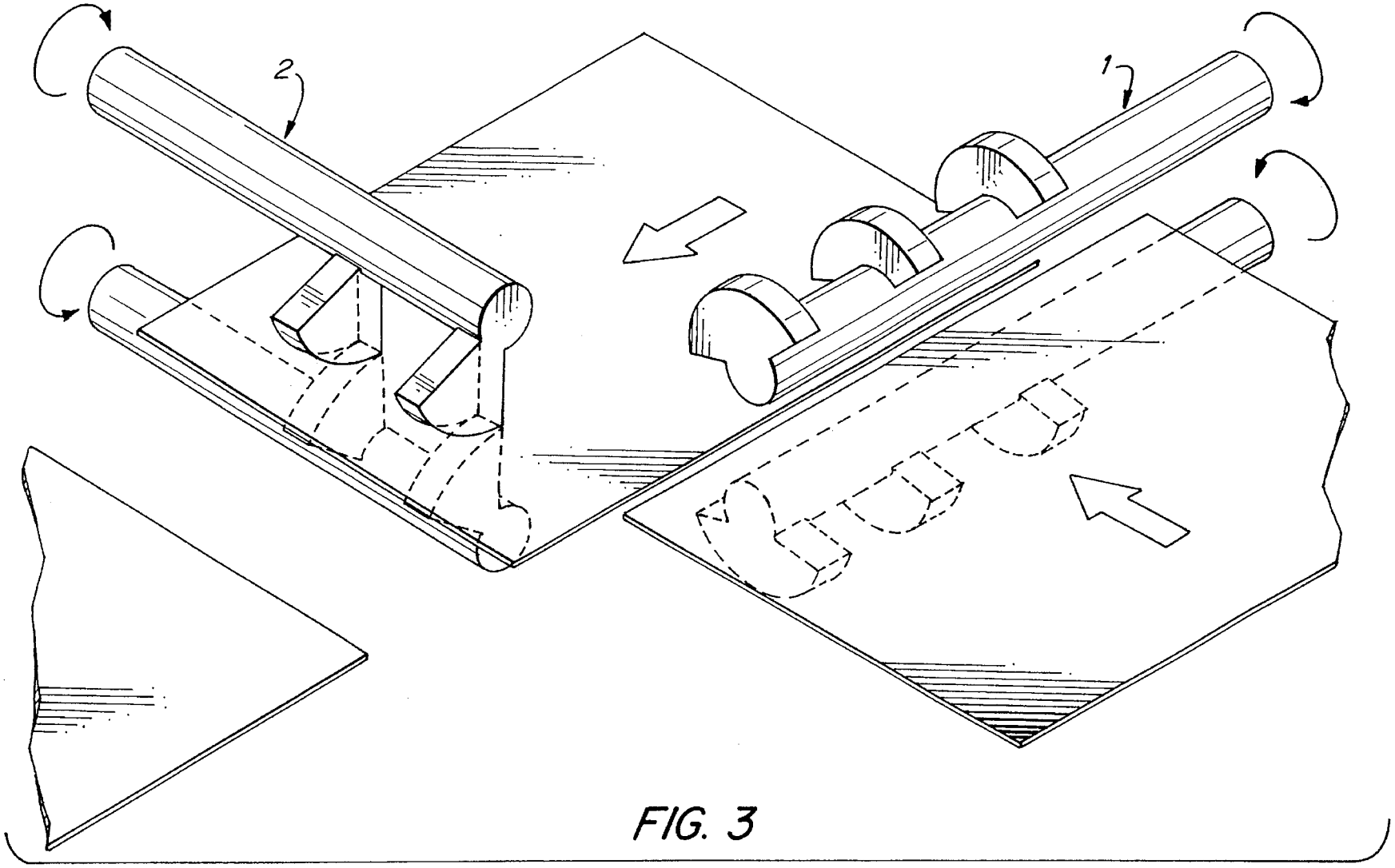
FIG. 3 shows the following stage, wherein the paper has been accelerated in a new direction deflected by 90° and another paper is arriving between arrester cylinders.
Figure 4:
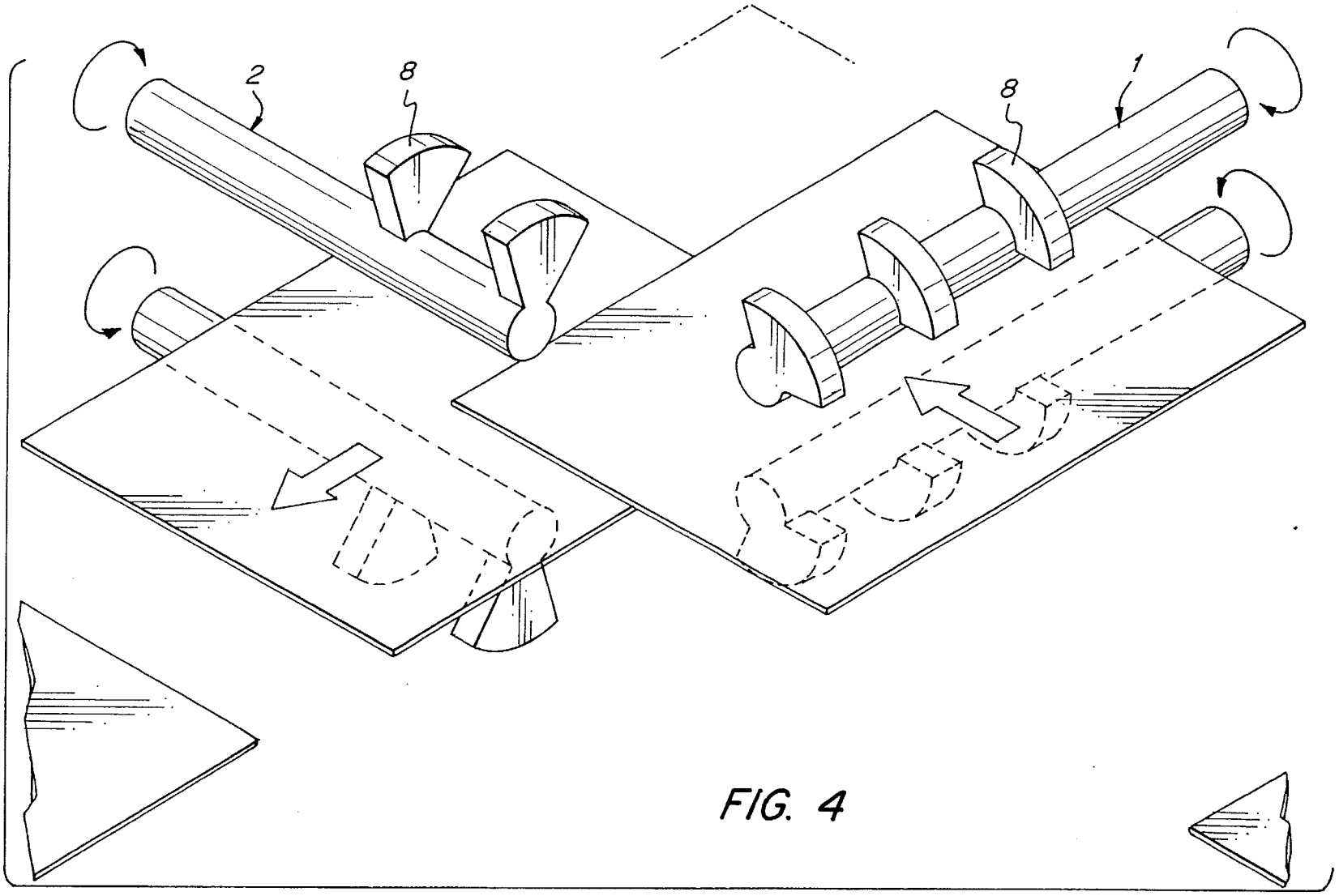
FIG. 4 shows the following stage, wherein the paper accelerated to a new speed exits from between a pair of acceleration cylinders 2 and the paper to be decelerated has arrived between a pair of cylinders 1. Each paper travels freely between the pairs of cylinders in its own direction and at its own speed, which can be equal or unequal.

Both pairs of cylinders 1 and 2 are provided with sector-shaped protrusions 8, the paper being pressed therebetween whenever the protrusions 8 in both cylinders of the pair of cylinders 1 or 2 are located on the line extending between the centre axes thereof. The protrusions have a sector angle which is typically well below 180° and, thus, the papers are capable of moving freely at speeds assigned thereto between the pairs of cylinders 1 and 2 at any time except when the sector protrusions 8 are set against each other. In the case of FIG. 4, for example, the trailing edge of a paper accelerated in a new direction must pass the meeting point of the sector protrusions 8 of the cylinders 2 before the sector protrusions 8 come into contact with each other and take hold of the edge of the arrested paper.

Each cylinder is provided with a plurality of sector protrusions 8 at an axial distance from each other in an axially directed row.

Figure 5:
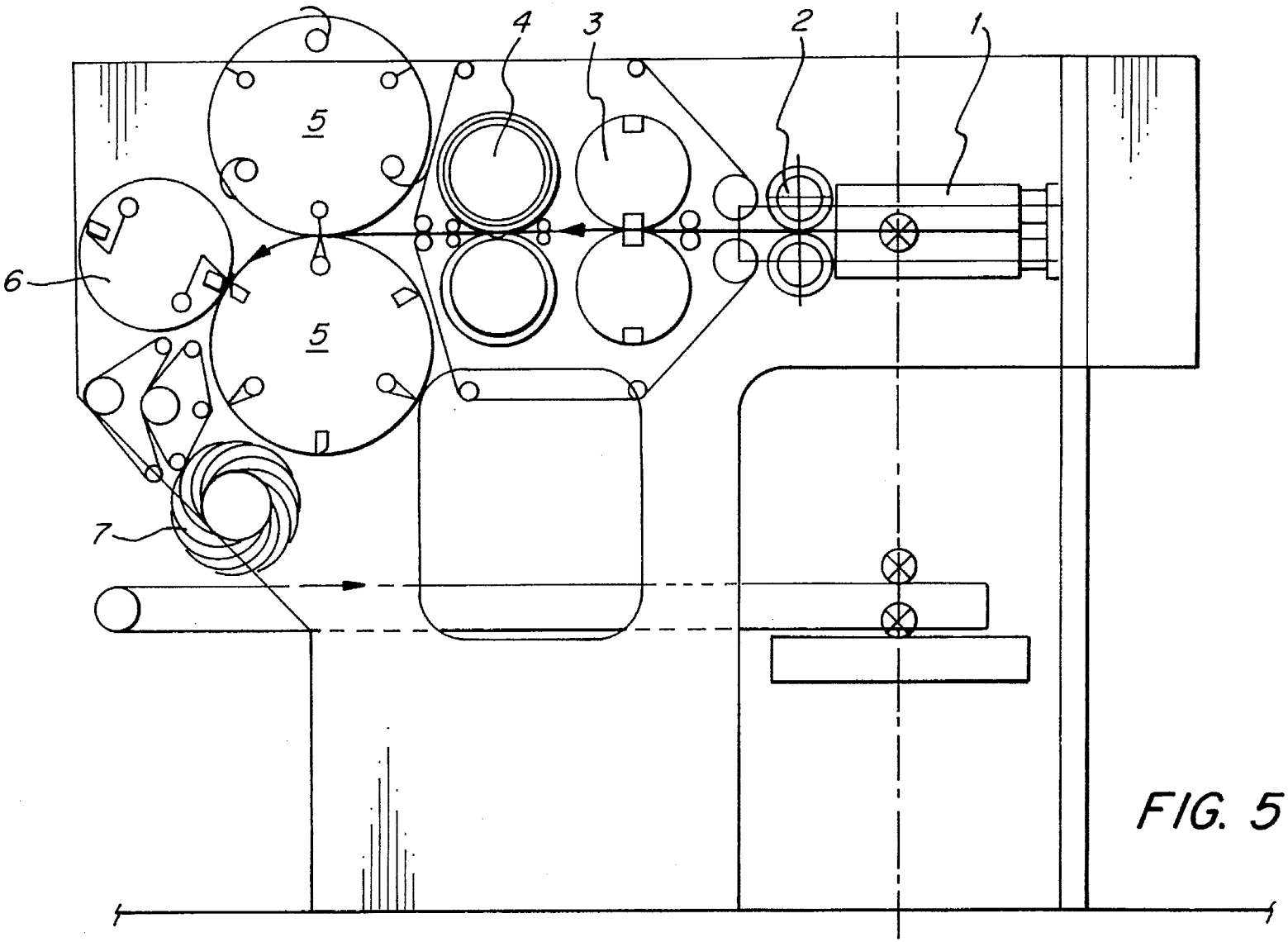
FIG. 5 shows schematically in a side view a printing machine trimmer capable of applying a feed deflection apparatus of the invention.

The trimmer embodiment of FIG. 5 is intended for such printing machines, wherein the pages are set upright on a printing cylinder. The trimmer first includes arrester cylinders 1 having segmental jackets for arresting or stopping an article (an at least partially made-up paper or magazine) by the trailing edge. There is a strong compression between the cylinders 1 and the cylinders are decelerated at a uniform rate from a full speed to the 0-speed. There is no slipping of the article at any time.

This is followed by acceleration cylinders 2 at an angle of 90° relative to the former cylinders. These accelerate the article to a desired speed taking hold of the leading edge of the paper. The paper travels next with its back facing forward to a rotary stapler 3 for stapling the article.

At the next stage, the trimming-off of the paper ends is effected by means of large (ϕ 300) slitters. At this point, it is important to maintain the paper in its alignment by means of a strong compression applied at several locations.

This trimming of the ends is followed by a cylinder folding corresponding to the Chopper-folding and effected by means of folding cylinders 5. The trimming-off of the side of a paper is effected by means of a transverse cutter associated with a cutting cylinder 6 against a gripper cylinder 5.

Thereafter, the paper can be delivered onto a conveyor by means of a star wheel 7 to form an overlap stream or to carry the papers to mailing separately in succession.

I claim:

1. A feed deflection apparatus for at least partially folded newspapers or magazines, whereby the feeding direction of papers is deflected by 90° and which includes at least two pairs of cylinders (1, 2) through which the feeding of papers is effected, characterized in that the apparatus includes a pair of arrester cylinders (1) and a pair of acceleration cylinders (2) which are substantially coplanar but at an angle of 90° relative to each other, whereby a paper being pressed by the tail between the pair of arrester cylinders is arrested or stopped by decelerating the cylinders controllably at such a rate of deceleration that there is no slipping of the paper between the pair of cylinders (1) and, at the moment the paper has stopped, the pair of acceleration cylinders (2) takes hold of the paper's edge and accelerates the paper to a new speed directed at an angle of 90° relative to the former direction.

2. An apparatus as set forth in claim 1, characterized in that the pairs of cylinders (1, 2) are provided with sector-shaped protrusions (8), the paper being pressed therebetween whenever the protrusions (8) in both cylinders of the pairs of cylinders (1, 2) are located on the line extending between the centre axes thereof.

3. An apparatus as set forth in claim 2, characterized in that the protrusions (8) have a sector angle which is less than 180°.

4. An apparatus as set forth in claim 1, characterized in that the stopping of the pair of arrester cylinders is effected in synchronization with a printing machine or some other feeding machine and the accelerations of the pair of acceleration cylinders have a frequency which is equal to that of the arrests effected by the pair of arrester cylinders.

5. The practical application of a feed deflection apparatus as set forth in claim 1 in the trimmer of a printing machine, characterized in that in the advancing direction of a stream of articles said feed deflection apparatus is followed by one or a plurality of the following equipment: a stapler for the back of a paper, a slitter for the ends of a papers, folding cylinders, a transverse cutter for trimming off the side of a paper.

6. An apparatus as set forth in claim 2, characterized in that the stopping of the pair of arrester cylinders is effected in synchronization with a printing machine or some other feeding machine and the accelerations of the pair of acceleration cylinders have a frequency which is equal to that of the arrests effected by the pair of arrester cylinders.

7. An apparatus as set forth in claim 3, characterized in that the stopping of the pair of arrester cylinders is effected in synchronization with a printing machine or some other feeding machine and the accelerations of the pair of acceleration cylinders have a frequency which is equal to that of the arrests effected by the pair of arrester cylinders.

8. The practical application of a feed deflection apparatus as set forth in claim 2 in the trimmer of a printing machine, characterized in that in the advancing direction of a stream of articles said feed deflection apparatus is followed by one or a plurality of the following equipment: a stapler for the back of a paper, a slitter for the ends of a paper, folding cylinders, a transverse cutter for trimming off the side of a paper.

9. The practical application of a feed deflection apparatus as set forth in claim 3 in the trimmer of a printing machine, characterized in that in the advancing direction of a stream of articles said feed deflection apparatus is followed by one or a plurality of the following equipment: a stapler for the back of a paper, a slitter for the ends of a paper, folding cylinders, a transverse cutter for trimming off the side of a paper.

10. The practical application of a feed deflection apparatus as set forth in claim 4 in the trimmer of a printing machine, characterized in that in the advancing direction of a stream of articles said feed deflection apparatus is followed by one or a plurality of the following equipment: a stapler for the back of a paper, a slitter for the ends of a paper, folding cylinders, a transverse cutter for trimming off the side of a paper.

* * * * *